US008451199B2

(12) United States Patent
Huang et al.

(10) Patent No.: US 8,451,199 B2
(45) Date of Patent: May 28, 2013

(54) COLOR ADJUSTMENT METHOD FOR COLOR SEQUENTIAL LIQUID CRYSTAL DISPLAY

(75) Inventors: Yi-Pai Huang, Chiayi (TW); Han-Ping Shieh, Hsinchu (TW); Yi-Ling Chen, Taichung County (TW); Fang-Cheng Lin, Taichung County (TW); Chun-Ho Chen, Changhua County (TW); Wen-Chih Tai, Jhubei (TW); Shian-Jun Chiou, Taipei (TW)

(73) Assignee: Chunghwa Picture Tubes, Ltd., Padeh, Taoyuan (TW)

( * ) Notice: Subject to any disclaimer, the term of this patent is extended or adjusted under 35 U.S.C. 154(b) by 429 days.

(21) Appl. No.: 12/792,113

(22) Filed: Jun. 2, 2010

(65) Prior Publication Data

US 2011/0187632 A1 Aug. 4, 2011

(30) Foreign Application Priority Data

Feb. 4, 2010 (TW) ..... 99103317 A

(51) Int. Cl.
*G09G 3/36* (2006.01)

(52) U.S. Cl.
USPC ..... 345/88

(58) Field of Classification Search
USPC ..... 345/88–89, 77, 83, 690
See application file for complete search history.

(56) References Cited

U.S. PATENT DOCUMENTS

| | | | | |
|---|---|---|---|---|
| 5,337,068 | A | 8/1994 | Stewart et al. | |
| 5,929,843 | A * | 7/1999 | Tanioka | 345/600 |
| 6,911,963 | B2 | 6/2005 | Baba et al. | |
| 7,301,543 | B2 * | 11/2007 | Higgins | 345/589 |
| 7,365,722 | B2 | 4/2008 | Lee | |
| 2008/0137328 | A1 | 6/2008 | Lee et al. | |

FOREIGN PATENT DOCUMENTS

| | | |
|---|---|---|
| TW | 200835976 | 12/1996 |
| TW | 2002-191055 | 7/2002 |

* cited by examiner

*Primary Examiner* — Alexander Eisen
*Assistant Examiner* — Robin Mishler
(74) *Attorney, Agent, or Firm* — Muncy, Geissler, Olds & Lowe, PLLC

(57) ABSTRACT

A color adjustment method for a color sequential liquid crystal display (LCD) having at least one white light source is provided. In the color adjustment method, firstly, an original image signal is converted into a target color point located in a chromaticity diagram in a color space. Then, a modified image signal having white data is calculated according to the original image signal. Afterwards, the modified image signal is converted into a main color point located in the chromaticity diagram by using a matrix group. Then, a plurality of subfield data are calculated according to the main color point and the target color point. The subfield data are used for enabling the main color point to fall on the target color point.

9 Claims, 4 Drawing Sheets

COLOR ADJUSTMENT METHOD FOR COLOR SEQUENTIAL LIQUID CRYSTAL DISPLAY

CROSS-REFERENCE TO RELATED APPLICATION

This application claims the benefit of Taiwan Patent Application No. 099103317, filed on Feb. 4, 2010, which is hereby incorporated by reference for all purposes as if fully set forth herein.

BACKGROUND OF THE INVENTION

1. Field of the Invention

The present invention relates to an image adjustment method for a display, and more particularly to a color adjustment method for a color sequential liquid crystal display (LCD).

2. Related Art

When a conventional color sequential LCD displays images, the color breakup phenomenon often occurs, thereby resulting in the deteriorated image quality. In detail, when the conventional color sequential LCD displays a dynamic image with a moving object, a viewer stares at the object unconsciously, and tracks the movement of the object.

At this time, three primary color fields forming an image of the object, that is, a red field, a green field, and a blue field, are not projected onto the same position on a retina, so that the viewer may consider that colors are separated like a rainbow at the edge of the moving object.

In order to alleviate the color breakup phenomenon, it has been currently proposed that a white field is displayed immediately after the three primary color fields are displayed, that is, the color sequential LCD circularly and sequentially displays the red field, the green field, the blue field, and the white field, so as to reduce the adverse effect on the image quality caused by the color breakup phenomenon.

A backlight module of the color sequential LCD generally uses three types of light-emitting diodes (LEDs), that is, red, green, and blue LEDs. When the white field is displayed, all of the LEDs emit light at the same time, so as to emit white light by mixing red light, green light, and blue light. However, since all of the LEDs emit light at the same time, an excessively high instantaneous power is generated when the white field is displayed.

SUMMARY OF THE INVENTION

Accordingly, the present invention is directed to a color adjustment method for a color sequential LCD, so as to reduce the adverse effect on the image quality caused by the color breakup phenomenon and meanwhile to reduce the instantaneous power.

The present invention provides a color adjustment method for a color sequential liquid crystal display (LCD) having at least one white light source. In the color adjustment method, firstly, an original image signal is converted into a target color point located in a chromaticity diagram in a color space. Then, a modified image signal having white data is calculated according to the original image signal. Afterwards, the modified image signal is converted into a main color point located in the chromaticity diagram by using a matrix group. Then, a plurality of subfield data are calculated according to the main color point and the target color point. The subfield data are used for enabling the main color point to fall on the target color point.

Based on the above, in the present invention, a white light source is used for displaying a main field, so as to reduce the adverse effect on the image quality caused by the color breakup phenomenon and meanwhile to reduce the instantaneous power.

In order to make the aforementioned features and advantages of the present invention more comprehensible, embodiments accompanied with figures are described in detail below.

DETAILED DESCRIPTION OF THE INVENTION

Figure 1:
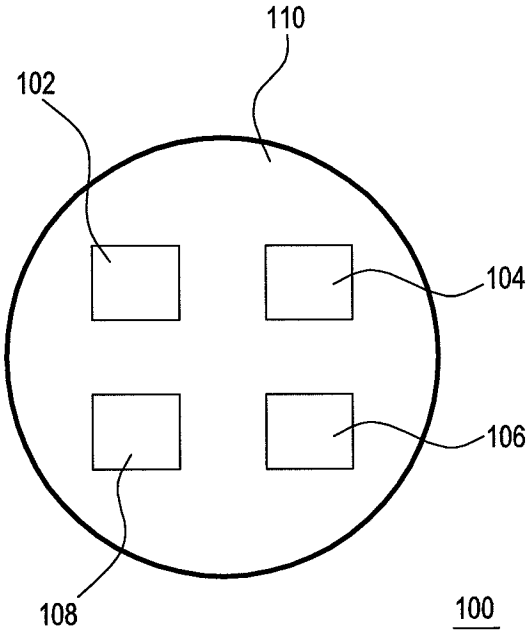
FIG. 1 shows a light source assembly applied in a color adjustment method for a color sequential LCD according to an embodiment of the present invention.

FIG. 1 shows a light source assembly applied in a color adjustment method for a color sequential LCD according to an embodiment of the present invention. Referring to FIG. 1, the color adjustment method according to this embodiment is applied in a color sequential LCD having at least one light source assembly 100, and the light source assembly 100 may be disposed in a backlight module of the color sequential LCD.

Based on the above, the light source assembly 100 includes at least one white light source 102, a plurality of monochromatic light sources 104, 106, and 108, and a circuit board 110. The white light source 102 and the monochromatic light sources 104, 106, and 108 are assembled on the circuit board 110, and all the white light source 102 and the monochromatic light sources 104, 106, and 108 may be LEDs.

In detail, the white light source 102 may be a white LED, and the monochromatic light sources 104, 106, and 108 may be a red LED, a green LED, and a blue LED respectively. The monochromatic light source 104 is used for displaying a red field, the monochromatic light source 106 is used for displaying a green field, and the monochromatic light source 108 is used for displaying a blue field. The white light source 102 is used for displaying a white field or used in combination with at least one of the monochromatic light sources 104 to 108 to display a mixed color field.

Moreover, the white light source 102 is a common white LED, which generally emits white light with a color temperature of 6500 K. Therefore, the white light emitted from the white light source 102 is slightly blue.

In this embodiment, the white light source 102 and the monochromatic light sources 104, 106, and 108 may be LED chips, and the circuit board 110 shown in FIG. 1 is a chip package carrier. Therefore, the light source assembly 100 may be a chip package for integrating the white light source 102 with the monochromatic light sources 104, 106, and 108, for example, the light source assembly 100 is a 4 in 1 chip package.

However, it should be noted that, in other embodiments (no shown), the white light source 102 and the monochromatic light sources 104, 106, and 108 may be chip packages, and the circuit board 110 may be a printed circuit board (PCB) for assembling the chip packages.

Figure 2A:
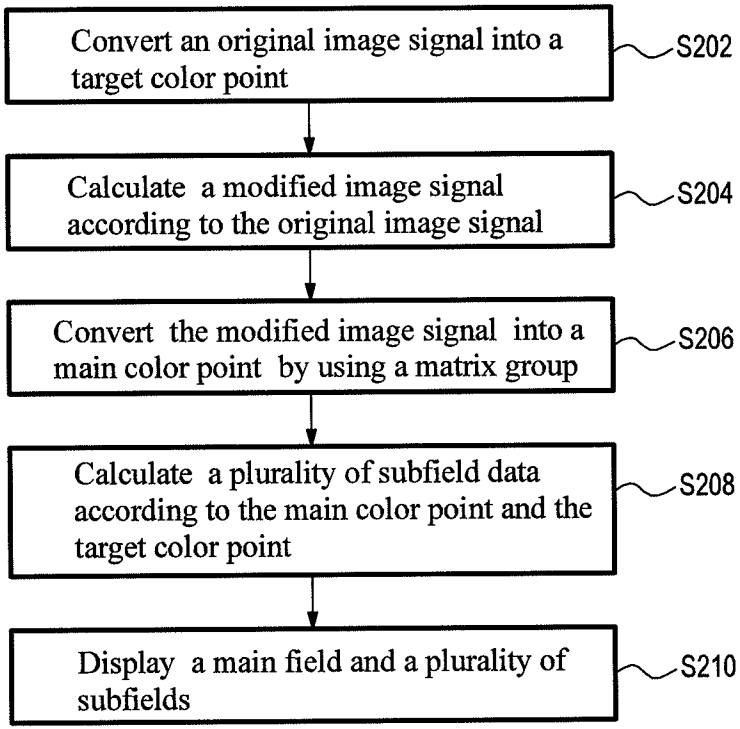
FIG. 2A is a schematic flow chart of a color adjustment method for a color sequential LCD according to an embodiment of the present invention.
Figure 2B:
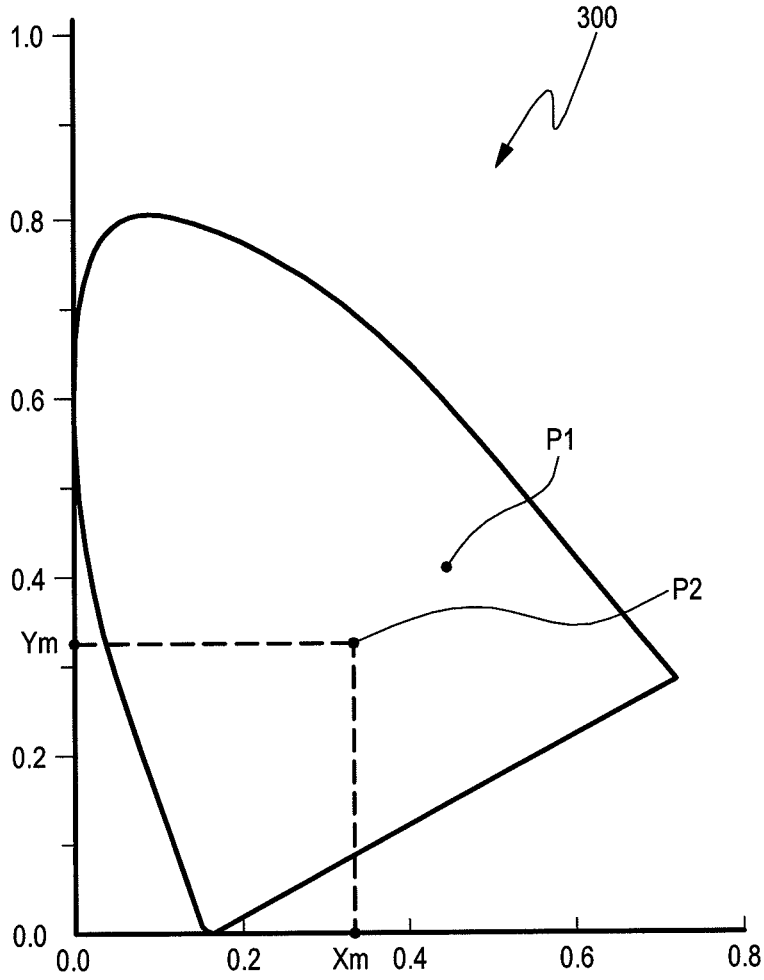
FIG. 2B is a chromaticity diagram depicted according to the color adjustment method of FIG. 2A.

FIG. 2A is a schematic flow chart of a color adjustment method for a color sequential LCD according to an embodiment of the present invention, and FIG. 2B is a chromaticity diagram depicted according to the color adjustment method of FIG. 2A. Referring to FIGS. 2A and 2B, in the color adjustment method for the color sequential LCD according to this embodiment, firstly, in Step S202, an original image signal is converted into a target color point P1.

In detail, the target color point P1 is located in a chromaticity diagram 300 in a color space, as shown in FIG. 2B. The color space is, for example, a CIE XYZ color space, and the chromaticity diagram 300 shown in FIG. 2B is a CIE 1931 chromaticity diagram. However, in other embodiments (no shown), the chromaticity diagram 300 may also be a CIE 1960 chromaticity diagram or a CIE 1976 chromaticity diagram.

The original image signal may be used for controlling a liquid crystal gray level of an LCD panel. The original image signal has an original red gray-level value, an original green gray-level value, and an original blue gray-level value. The original red gray-level value, the original green gray-level value, and the original blue gray-level value may all belong to 6-bit (64) gray level or 8-bit (256) gray level, and may be normalized gray-level values.

Then, in Step S204, a modified image signal is calculated according to the original image signal. The modified image signal has white data and a plurality of primary color gray-level values. The white data may have a white gray-level value. The primary color gray-level values are a red gray-level value, a green gray-level value, and a blue gray-level value respectively.

The modified image signal may be calculated by many ways, and in this embodiment, the modified image signal is calculated through the following steps. Firstly, the white gray-level value is generated according to the original red gray-level value, the original green gray-level value, and the original blue gray-level value of the original image signal.

Considering the method for generating the white gray-level value, in this embodiment, a smallest gray-level value among the original red gray-level value, the original green gray-level value, and the original blue gray-level value is taken to serve as the white gray-level value. Then, the white gray-level value is subtracted from the original red gray-level value, the original green gray-level value, and the original blue gray-level value, so as to calculate the primary color gray-level values, that is, the red gray-level value, the green gray-level value, and the blue gray-level value. Therefore, the modified image signal is calculated.

In order to illustrate the above method for calculating the modified image signal in further detail, the demonstration is given below by taking an 8-bit (256) gray level standard as an example. It is assumed that an original image signal has an original red gray-level value of 200, an original green gray-level value of 150, and an original blue gray-level value of 50. In this case, the original blue gray-level value is the smallest gray-level value, so that the white gray-level value is set as 50.

Then, the white gray-level value is subtracted from the original red gray-level value, the original green gray-level value, and the original blue gray-level value, so as to obtain the red gray-level value, the green gray-level value, and the blue gray-level value. Here, the red gray-level value is 150 (200−50=150), the green gray-level value is 100 (150−50=100), and the blue gray-level value is 0 (50−50=0). Therefore, the modified image signal can be calculated.

After Step S204 is performed, performing Step S206, that is, the modified image signal is converted into a main color point P2 by using a matrix group. The main color point P2 is located in the chromaticity diagram 300, and the matrix group includes a red light conversion matrix, a green light conversion matrix, a blue light conversion matrix, and a white light conversion matrix.

The method for converting the modified image signal into the main color point P2 may include the following steps: calculating the main color point P2 through the following mathematic expression (1).

$$\begin{bmatrix} Xm \\ Ym \\ Zm \end{bmatrix} = Mr \times Lr \times Br + Mg \times Lg \times Bg + Mb \times Lb \times Bb + Mw \times Lw \times Bw \tag{1}$$

In the above equation, $$\begin{bmatrix} Xm \\ Ym \\ Zm \end{bmatrix}$$

is coordinates of the main color point P2, that is, the main color point P2 is projected onto Point Xm on the X axis and Point Ym on the Y axis of the chromaticity diagram 300. As for Zm, since the CIE 1931 chromaticity diagram is an X-Y plane taken from a CIE XYZ color space when Zm is a constant value, so that Zm is not shown in the chromaticity diagram 300 of FIG. 2B.

Mr, Mg, Mb, and Mw represent the matrix group, in which Mr is the red light conversion matrix, Mg is the green light conversion matrix, Mb is the blue light conversion matrix, and Mw is the white light conversion matrix. Lr, Lg, Lb, and Lw represent the modified image signal, in which Lw is the white gray-level value in the white data, and Lr, Lg, and Lb are the primary color gray-level values of the modified image signal, that is, Lr is the red gray-level value, Lg is the green gray-level value, and Lb is the blue gray-level value.

Referring to FIG. 1 again, Br is red backlight data, Bg is green backlight data, Bb is blue backlight data, and Bw is white backlight data. Br, Bg, Bb, and Bw represent luminous signals of the light source assembly 100. The white backlight data is obtained according to white light emitted from the white light source 102, and the white light has a color temperature of substantial 6500 K. The red backlight data, the green backlight data, and the blue backlight data are obtained according to color light emitted from the monochromatic light sources 104, 106, and 108 respectively.

In addition, in this embodiment, the gray-level values Lr, Lg, Lb, and Lw and the backlight data Br, Bg, Bb, and Bw may be adjusted by using the dimming technique. In detail, taking the red gray-level value Lr and the red backlight data Br as an example, Lr and Br may be changed while keeping the value of (Lr×Br) constant. That is to say, when Lr is adjusted to a high value, Br is adjusted to a low value. On the contrary, when Lr is adjusted to a low value, Br is adjusted to a high value.

Likewise, Lg and Bg may be changed while keeping the value of (Lg×Bg) constant, Lb and Bb may be changed while keeping the value of (Lb×Bb) constant, and Lw and Bw may be changed while keeping the value of (Lw×Bw) constant.

Figure 3:
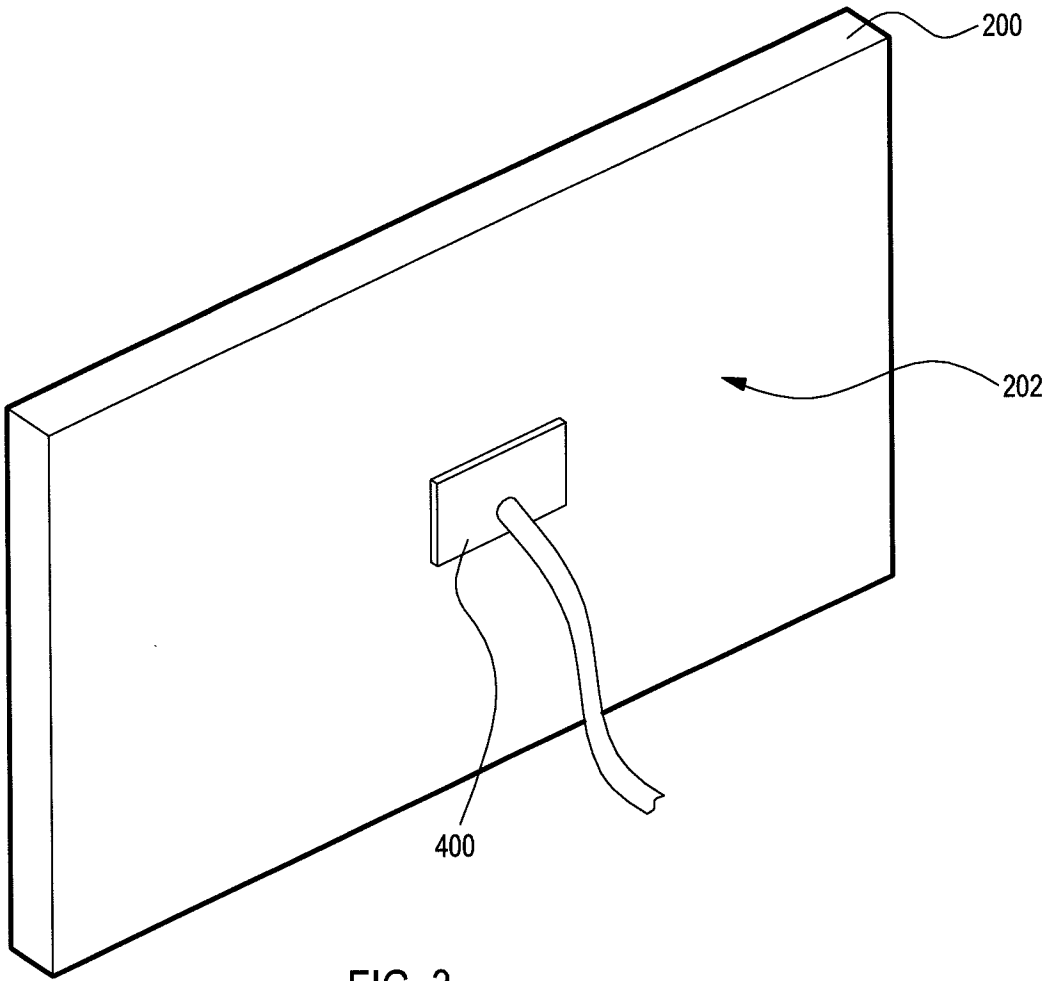
FIG. 3 is a schematic view of a method for obtaining a conversion matrix.

Referring to FIGS. 1 and 3, a method for obtaining the red light conversion matrix Mr, the green light conversion matrix Mg, the blue light conversion matrix Mb, or the white light conversion matrix Mw in the mathematic expression (1) may include the following steps.

The color sequential LCD in this embodiment further has an LCD panel 200 (as shown in FIG. 3). In the method for obtaining the red light conversion matrix Mr, the green light conversion matrix Mg, the blue light conversion matrix Mb, or the white light conversion matrix Mw, firstly, a luminous flux of the LCD panel 200 is adjusted to a maximum value, and only one type of monochromatic light source is turned on, while the other monochromatic light sources are turned off. That is to say, only a monochromatic light source of a certain color is turned on.

The monochromatic light source that is turned on may be the monochromatic light source 104, the monochromatic light source 106, the monochromatic light source 108, or the white light source 102 shown in FIG. 1, in which the monochromatic light source 104 is a red light source, the monochromatic light source 106 is a green light source, and the monochromatic light source 108 is a blue light source. In addition, in the step of adjusting the luminous flux of the LCD panel 200 to the maximum value, the arrangement of liquid crystal molecules in the LCD panel 200 is controlled to enable the LCD panel 200 to achieve the highest light transmittance.

When the luminous flux of the LCD panel 200 reaches the maximum value, and only one type of monochromatic light source is turned on, for example, only the white light source 102 or one of the monochromatic light sources 104 to 108 is turned on, a first color point is detected from a display surface 202 of the LCD panel 200. The first color point is located in a color space, and the color space is, for example, a CIE XYZ color space. The first color point may be detected using an instrument 400, and the instrument 400 is, for example, a colorimeter.

Then, the luminous flux of the LCD panel 200 is adjusted to a minimum value, and only the above turned-on monochromatic light source is turned on. In the step of adjusting the luminous flux of the LCD panel 200 to the minimum value, the arrangement of liquid crystal molecules in the LCD panel 200 is controlled to enable the LCD panel 200 to have the lowest light transmittance. Theoretically, the display surface 202 is black at this time. However, since the light leakage inevitably occurs to the LCD panel 200, the color presented by a second color point is not black in fact.

When the luminous flux of the LCD panel 200 reaches the minimum value, and only the above turned-on monochromatic light source is turned on, the second color point located in the color space is detected from the display surface 202. Afterwards, coordinates of the second color point are subtracted from coordinates of the first color point. Therefore, the red light conversion matrix Mr, the green light conversion matrix Mg, the blue light conversion matrix Mb, and the white light conversion matrix Mw are obtained.

In order to illustrate the above method for obtaining the red light conversion matrix Mr, the green light conversion matrix Mg, the blue light conversion matrix Mb, or the white light conversion matrix Mw in further detail, the demonstration is given below by taking the green light conversion matrix Mg as an example with reference to FIGS. 1 and 3.

Firstly, the luminous flux of the LCD panel 200 is adjusted to the maximum value, and only the green light source, that is, the monochromatic light source 106 is turned on, whereas the monochromatic light sources 104 and 108 and the white light source 102 are turned off. When the luminous flux of the LCD panel 200 reaches the maximum value, and only the green light source is turned on, the first color point (Xg1,Yg1,Zg1) located in the color space is detected from the display surface 202.

Then, the luminous flux of the LCD panel 200 is adjusted to the minimum value, and only the green light source is turned on, whereas the monochromatic light sources 104 and 108 and the white light source 102 are still turned off. When the luminous flux of the LCD panel 200 reaches the minimum value, and only the green light source is turned on, the second color point (Xg2,Yg2,Zg2) located in the color space is detected from the display surface 202.

Afterwards, the coordinates (Xg2,Yg2,Zg2) of the detected second color point are subtracted from the coordinates (Xg1,Yg1,Zg1) of the detected first color point, that is, Xg2 is subtracted from Xg1, Yg2 is subtracted from Yg1, and Zg2 is subtracted from Zg1, thereby obtaining the green light conversion matrix Mg as shown below.

$$Mg = \begin{bmatrix} Xg1 - Xg2 \\ Yg1 - Yg2 \\ Zg1 - Zg2 \end{bmatrix}$$

Likewise, by analogy, the red light conversion matrix Mr, the blue light conversion matrix Mb, and the white light conversion matrix Mw are obtained according to the above method for obtaining the green light conversion matrix Mg.

Based on the above, the light leakage inevitably occurs to the LCD panel 200, which affects the image color to some extent, and even results in distortion of coordinates of the main color point P2. However, through the green light conversion matrix Mg, the red light conversion matrix Mr, the blue light conversion matrix Mb, and the white light conversion matrix Mw, the correctness of the main color point P2 can be improved.

Referring to FIGS. 2A and 2B, after Step S206 is performed, performing Step S208, a plurality of subfield data are calculated according to the main color point P2 and the target color point P1. The subfield data are used for enabling the main color point P2 to fall on the target color point P1. That is to say, the subfield data are used for correcting the main color point P2, such that the color sequential LCD can enable pixels to display the color represented by the target color point P1 by using the white light source 102 (referring to FIG. 1), thereby displaying a correct image according to the original image signal.

In this embodiment, the subfield data belong to liquid crystal gray-level data, and may be red field data, green field data, and blue field data respectively. In detail, the subfield data can control the liquid crystal gray level of the LCD panel, so as to correct the main color point P2. Definitely, in other embodiments, the main color point P2 may be corrected by controlling the liquid crystal gray level and the luminous signal of the light source assembly 100 at the same time.

The subfield data may be calculated using the following mathematic expression (2).

$$\begin{bmatrix} Xt \\ Yt \\ Zt \end{bmatrix} = \begin{bmatrix} Xm \\ Ym \\ Zm \end{bmatrix} + [Mr, Mg, Mb]_{3\times3} * \begin{bmatrix} R \\ G \\ B \end{bmatrix} \quad (2)$$

$$\begin{bmatrix} Xt \\ Yt \\ Zt \end{bmatrix}$$

is coordinates of the target color point P1, and $$\begin{bmatrix} R \\ G \\ B \end{bmatrix}$$

is the subfield data, in which R is the red field data, G is the green field data, and B is the blue field data.

$$\begin{bmatrix} Xt \\ Yt \\ Zt \end{bmatrix},$$

$$\begin{bmatrix} Xm \\ Ym \\ Zm \end{bmatrix},$$

Mr, Mg, and Mb are known, so that $$\begin{bmatrix} R \\ G \\ B \end{bmatrix}$$

may be calculated by using simple linear algebra.

Afterwards, Step S210 may be performed, that is, a main field and a plurality of subfields are displayed. The main field is displayed according to the main color point P2

$$\left(\text{that is, the coordinates} \begin{bmatrix} Xm \\ Ym \\ Zm \end{bmatrix}\right),$$

and the subfields are displayed according to the subfield data. The main field may be a white field or a mixed color field, and the subfields include a red field, a green field, and a blue field.

When the main field is a mixed color field, not only the white light source 102 in FIG. 1 emits white light, but also one of the monochromatic light sources 104, 106, and 108 emits light along with the white light source 102 at the same time, so that the color of the mixed color field may be yellow, purple, or orange etc.

The color of the mixed color field may be determined according to the original image signal. For example, if an image to be presented by the original image signal is a scene of a blue coast and sky, the color of the mixed color field uses cyan. Thus, the adverse effect on the image quality caused by the color breakup phenomenon may also be reduced.

In addition, the original image signal may further have original red backlight data, original green backlight data, and original blue backlight data, and the white data in the modified image signal may further have white backlight data. When the main field is a mixed color field, the method for calculating the modified image signal according to this embodiment not only generates the white gray-level value, but also generates the white backlight data at the same time.

In detail, the method for calculating the modified image signal may further include the following steps. The white backlight data is generated according to the original red backlight data, the original green backlight data, and the original blue backlight data. Considering the method for generating the white backlight data, the smallest value among the original red backlight data, the original green backlight data, and the original blue backlight data may be taken to serve as the white backlight data.

Then, the white backlight data is subtracted from the original red backlight data, the original green backlight data, and the original blue backlight data. Thus, the backlight data of the calculated modified image signal includes the red backlight data, the green backlight data, the blue backlight data, and the white backlight data.

Based on the above, in the present invention, a white light source is used to display a main field that may be a white field or a mixed color field, and the white light source may be a white LED. Compared with the method for displaying a white field using red, green, and blue LEDs in the prior art, the present invention not only reduces the adverse effect on the image quality caused by the color breakup phenomenon, but also further reduces the instantaneous power. Thus, the present invention reduces the power consumption of the color sequential LCD, and increases the operating time of the color sequential LCD.

Besides, through the subfield data, the present invention enables the main color point to fall on the target color point, so as to display a correct image color. Even if the white light emitted from the white light source slightly turns to another color (for example, a color temperature of 6500 K), the present invention can also faithfully display the image color to be presented by the original image signal. Therefore, the present invention not only reduces the adverse effect on the image quality caused by the color breakup phenomenon and meanwhile reduces the instantaneous power, but also faithfully displays the image color to be presented by the original image signal.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color adjustment method for a color sequential liquid crystal display (LCD), applied in a color sequential LCD having at least one white light source, the color adjustment method comprising:

converting an original image signal into a target color point located in a chromaticity diagram in a color space;

calculating a modified image signal having a white data according to the original image signal;

converting the modified image signal into a main color point located in the chromaticity diagram by using a matrix group;

calculating a plurality of subfield data according to the main color point and the target color point, wherein the subfield data are used for enabling the main color point to fall on the target color point displaying a plurality of subfields according to the subfield data, wherein the subfield data belong to a liquid crystal gray-level data; and displaying a main field according to the main color point;

wherein the original image signal has an original red gray-level value, an original green gray-level value, and an original blue gray-level value; the white data has a white gray-level value; and a method for calculating the modified image signal comprises:

generating the white gray-level value according to the original red gray-level value, the original green gray-level value, and the original blue gray-level value; and subtracting the white gray-level value from the original red gray-level value, the original green gray-level value, and the original blue gray-level value;

wherein the modified image signal further has a plurality of primary color gray-level values; the matrix group comprises a red light conversion matrix, a green light conversion matrix, a blue light conversion matrix, and a white light conversion matrix; and a method for converting the modified image signal into the main color point comprises:

calculating the main color point through a mathematic expression of $$\begin{bmatrix} Xm \\ Ym \\ Zm \end{bmatrix} = Mr \times Lr \times Br + Mg \times Lg \times Bg + Mb \times Lb \times Bb + Mw \times Lw \times Bw,$$

wherein $$\begin{bmatrix} Xm \\ Ym \\ Zm \end{bmatrix}$$

is coordinates of the main color point;

Mr is the red light conversion matrix, Mg is the green light conversion matrix, Mb is the blue light conversion matrix, and Mw is the white light conversion matrix;

Lr, Lg, and Lb are the primary color gray-level values, and Lw is the white gray-level value; and Br is a red backlight data, Bg is a green backlight data, Bb is a blue backlight data, and Bw is a white backlight data;

wherein a method for obtaining the red light conversion matrix, the green light conversion matrix, the blue light conversion matrix, or the white light conversion matrix comprises:

when a luminous flux of an LCD panel reaches a maximum value and only one type of monochromatic light source is turned on, detecting a first color point located in the color space from a display surface of the LCD panel, wherein the monochromatic light source is a red light source, a green light source, a blue light source, or the white light source;

when the luminous flux of the LCD panel reaches a minimum value and only the monochromatic light source is turned on, detecting a second color point located in the color space from the display surface; and subtracting coordinates of the second color point from coordinates of the first color point.

2. The color adjustment method for a color sequential LCD according to claim 1, wherein the color space is a CIE XYZ color space.

3. The color adjustment method for a color sequential LCD according to claim 1, wherein the main field is a white field.

4. The color adjustment method for a color sequential LCD according to claim 1, wherein a method for generating the white gray-level value comprises:

taking a smallest gray-level value among the original read gray-level value, the original green gray-level value, and the original blue gray-level value to serve as the white gray-level value.

5. The color adjustment method for a color sequential LCD according to claim 1, wherein the subfield data are calculated using a mathematic expression of:

$$\begin{bmatrix} Xt \\ Yt \\ Zt \end{bmatrix} = \begin{bmatrix} Xm \\ Ym \\ Zm \end{bmatrix} + [Mr, Mg, Mb]_{3\times3} * \begin{bmatrix} R \\ G \\ B \end{bmatrix}$$

wherein $$\begin{bmatrix} Xt \\ Yt \\ Zt \end{bmatrix}$$

is coordinates of the target color point, and $$\begin{bmatrix} R \\ G \\ B \end{bmatrix}$$

is the subfield data.

6. The color adjustment method for a color sequential LCD according to claim 1, wherein the white backlight data is obtained according to white light emitted from the white light source, the white light has a color temperature of 6500 K, and the white light source is a white light-emitting diode (LED).

7. The color adjustment method for a color sequential LCD according to claim 1, wherein the main field is a mixed color field.

8. The color adjustment method for a color sequential LCD according to claim 7, wherein the original image signal further has an original red backlight data, an original green backlight data, and an original blue backlight data; the white data further has a white backlight data; and the method for calculating the modified image signal comprises:

generating the white backlight data according to the original red backlight data, the original green backlight data, and the original blue backlight data; and subtracting the white backlight data from the original red backlight data, the original green backlight data, and the original blue backlight data.

9. The color adjustment method for a color sequential LCD according to claim 8, wherein a method for generating the white backlight data comprises:

taking a smallest value among the original red backlight data, the original green backlight data, and the original blue backlight data to serve as the white backlight data.

* * * * *